US010602248B2

(12) United States Patent
Chen

(10) Patent No.: US 10,602,248 B2
(45) Date of Patent: Mar. 24, 2020

(54) SPEAKER MODULE

(71) Applicant: AAC Technologies Pte. Ltd., Singapore (SG)

(72) Inventor: Wei Chen, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/236,505

(22) Filed: Dec. 30, 2018

(65) Prior Publication Data

US 2019/0342644 A1 Nov. 7, 2019

(30) Foreign Application Priority Data

May 4, 2018 (CN) ..... 2018 2 0655641 U

(51) Int. Cl.
*H04R 1/02* (2006.01)
*H04R 1/28* (2006.01)

(52) U.S. Cl.
CPC ..... *H04R 1/025* (2013.01); *H04R 1/288* (2013.01); *H04R 2499/11* (2013.01)

(58) Field of Classification Search
CPC ..... H04R 1/025; H04R 1/288; H04R 2499/11
See application file for complete search history.

(56) References Cited

U.S. PATENT DOCUMENTS

2002/0099891 A1* 7/2002 Cole ..... G06F 1/1616 710/200
2009/0233651 A1* 9/2009 Weckstrom ..... H04M 1/035 455/569.1
2015/0189412 A1* 7/2015 Shi ..... H04M 1/035 381/345
2016/0165327 A1* 6/2016 Crosby ..... H04R 1/2811 381/332
2018/0020283 A1* 1/2018 Zhang ..... F16K 25/005
2019/0215600 A1* 7/2019 Wang ..... H04R 1/025
2019/0253779 A1* 8/2019 Zhang ..... H04R 1/023

* cited by examiner

*Primary Examiner* — David L Ton
(74) *Attorney, Agent, or Firm* — IPro, PLLC; Na Xu

(57) ABSTRACT

The present disclosure provides a speaker module, in which at least two leaking holes that communicate with a rear chamber of the housing, and a connecting groove that communicates any two of the at least two leaking holes with each other are arranged at the housing. With such configuration, the processing steps for forming the cone-shaped leaking hole and the air guiding groove are omitted, the processing is significantly simplified compared to the prior art, the processing is much easier and the manufacture efficiency is higher, and an excellent performance in air leakage and pure sounding is guaranteed.

8 Claims, 3 Drawing Sheets

SPEAKER MODULE

CROSS-REFERENCE TO RELATED APPLICATIONS

The present application claims priority to Chinese Patent Application No. 201820655641.4, filed on May 4, 2018, the content of which is incorporated herein by reference in its entirety.

TECHNICAL FIELD

The present disclosure relates to the field of electroacoustic conversion and, in particular, to a speaker module.

BACKGROUND

With the advent of mobile internet, upgrading of electronic products is getting quicker and quicker, and people have higher and higher requirements on performance of the electronic products in various aspects. High quality music function is one of the various aspects. As a result, the electroacoustic system needs to be continuously improved. A high quality speaker module is one of the essential parts to realize the high quality music function.

A speaker module generally includes a housing and a speaker accommodated in the housing. During assembling of the speaker module, the speaker is installed first, then a damping sheet is attached to seal the housing, so as to accomplish the assembling process. In order to balance an internal pressure and an external pressure of the speaker module, a leaking structure is usually arranged on the housing for balancing the air pressure. In order to avoid failure of the leaking structure caused by shielding, in the prior art, the leaking structure generally includes a cone-shaped leaking hole with a decreasing diameter from inside to outside at the bottom of the housing, and an air guiding groove that is provided within the housing and in communication with the leaking hole. However, involved processing steps are complicated and the manufacture efficiency is low.

Therefore, it is necessary to provide a new speaker module to solve the above problem.

BRIEF DESCRIPTION OF DRAWINGS

Many aspects of the exemplary embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the drawings.

DESCRIPTION OF EMBODIMENTS

The present disclosure will be further illustrated with reference to the drawings.

Figure 1:
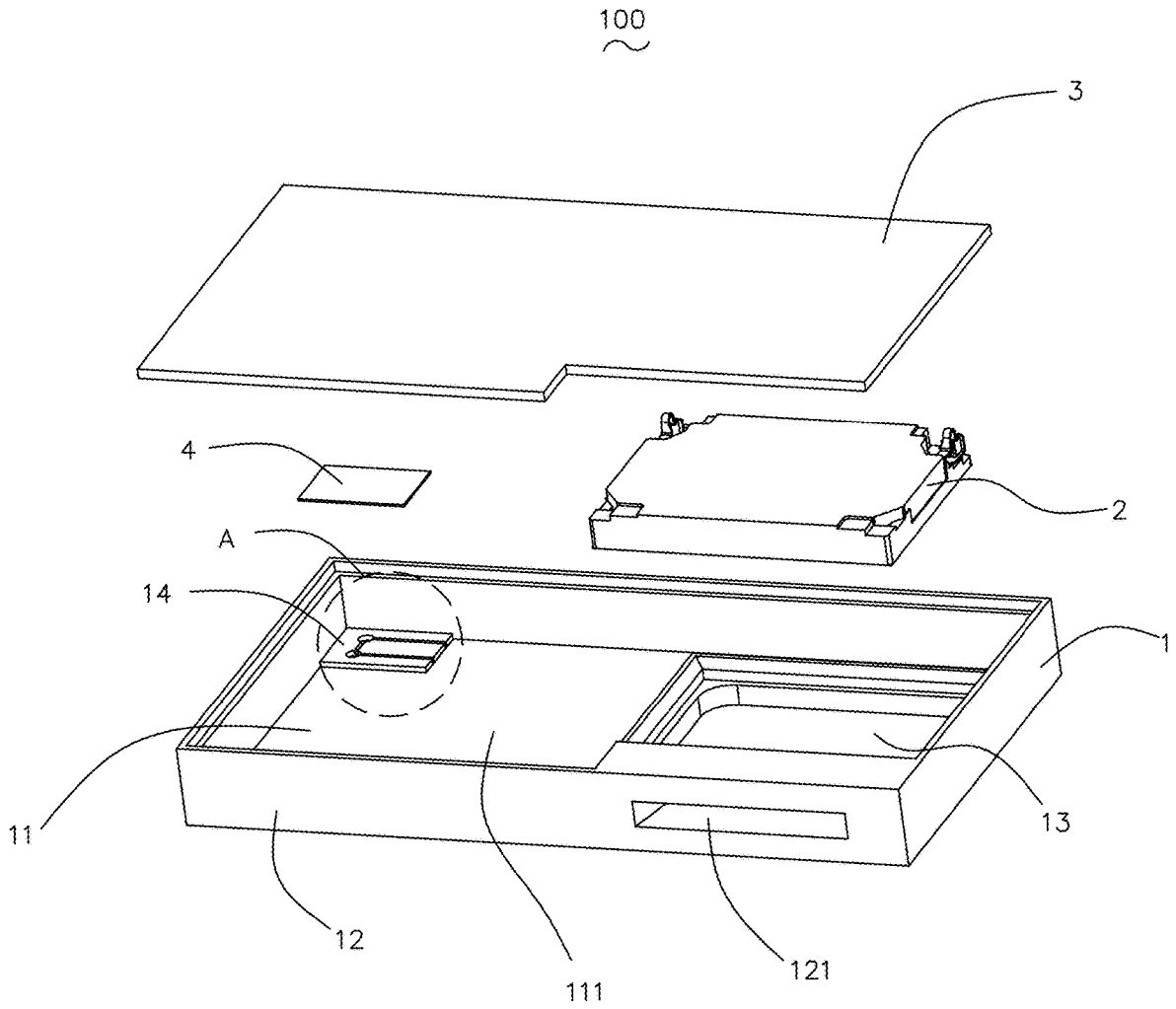
FIG. 1 is an exploded structural diagram of a speaker module in accordance with the present disclosure.
Figure 2:
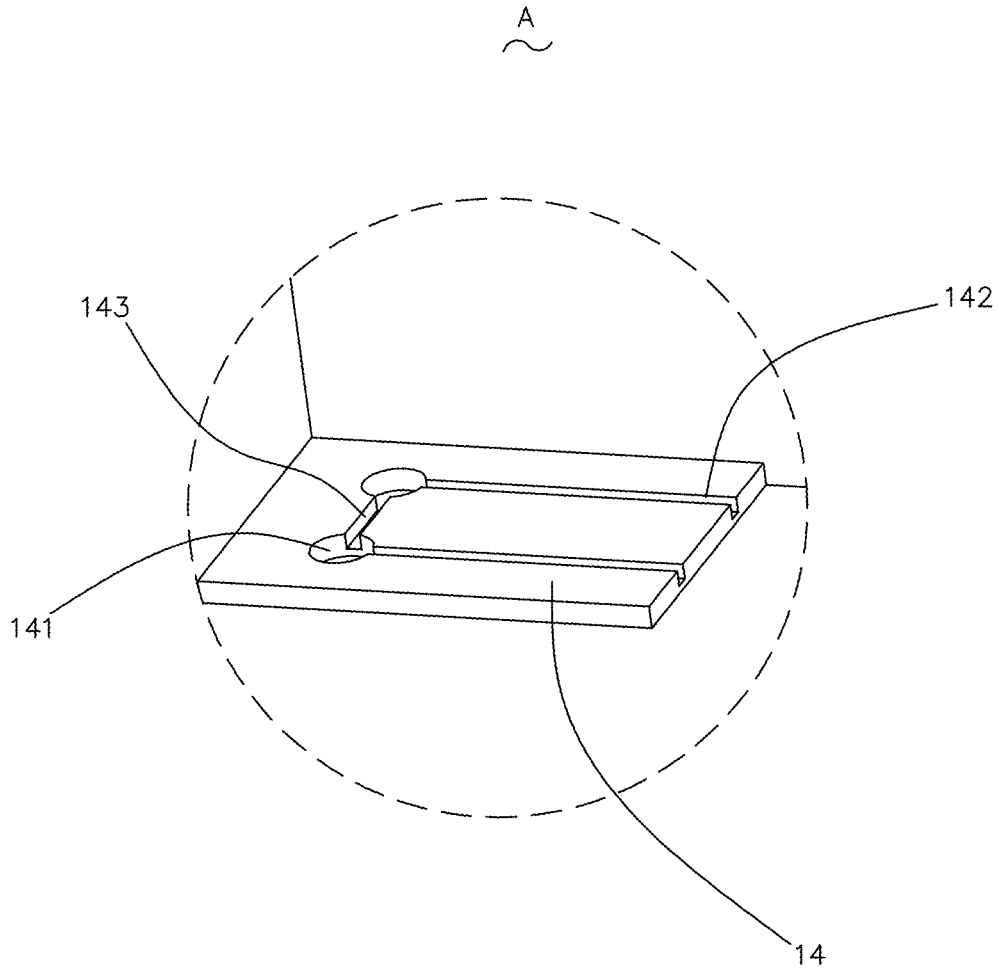
FIG. 2 is an enlarged view of portion A in FIG. 1.
Figure 3:
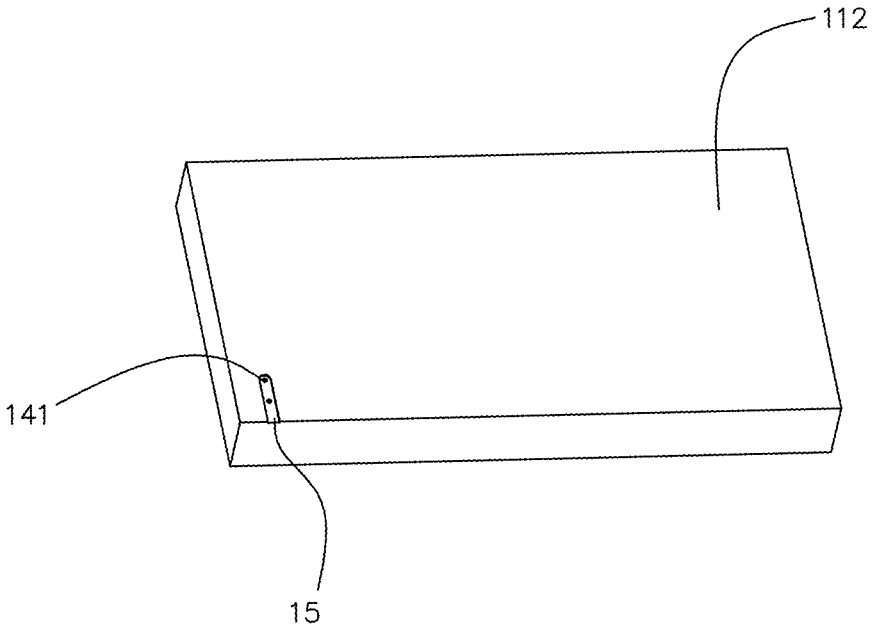
FIG. 3 is a schematic diagram of the speaker module in accordance with the present disclosure viewed from another angle after being assembled.

As shown in FIGS. 1-3, the present disclosure provides a speaker module 100, including a housing 1 having an accommodating space and a speaker 2 accommodated in the housing 1.

The housing 1 includes a bottom wall 11 and a side wall 12, and the bottom wall 11 and the side wall 12 together enclose the accommodating space. The side wall 12 is bent with respect to the bottom wall 11 and extends from the bottom wall 11, and the side wall 12 connects end to end and surrounds the accommodating space. The bottom wall 11 includes an inner surface 111 within the speaker module and an outer surface 112 outside the speaker module. A speaker fixing groove 13 for fixing the speaker 2 is provided on the inner surface 111.

In one embodiment, the speaker 2 is an electromagnetic speaker including a diaphragm and a coil for driving the diaphragm to vibrate. The speaker 2 is installed with its diaphragm side located within the speaker fixing groove 13. The speaker 2, especially the diaphragm of the speaker 2 partitions the accommodating space into a front chamber and a rear chamber. The speaker 2 and the speaker fixing groove 13 form the front chamber therebetween to achieve sounding of the speaker module. The speaker 2 and the housing form the rear chamber therebetween to increase low frequency response and to significantly reduce F0. A sound outlet 121 that communicates the front chamber with the external environment is provided in the side wall 12 of the housing 1. It is to be understood that the speaker 2 may be otherwise other types of sounding devices with the same principles as described herein. In one embodiment, the speaker module 100 further includes a cover plate 3 covering on the housing 1, and the cover plate 3 covers on the side wall 12 and is sealed with the housing 1. In an alternative embodiment, the cover plate 3 is not present, then the speaker module 100 can be directly installed on an external installation surface, e.g., a flat surface such as a mainboard or a housing of an electronic product, and the implementation principle is similar to the embodiment having the cover plate.

Since the housing 1 is fitted with the cover plate 3 or the external installation surface and is sealed thereto, a sealed space is formed within the housing 1. Due to the influence from environment alternation, the internal pressure and the external pressure may not be uniform, affecting the reliability of the product. In view of this, in one embodiment, a base 14 protruding towards the accommodating space is arranged on the inner surface 111 of the housing 1, and the base 14 has at least two leaking holes 141 successively penetrating through both the housing and the base. The hole diameter of the leaking hole 141 gradually decreases from a side of the base 14 facing away from the inner surface 111 to the outer surface 112. In one embodiment, a maximum hole diameter of the leaking hole is 0.17 mm-0.23 mm. The leaking hole 141 communicates with the rear chamber to achieve leakage of the rear chamber, thereby providing balanced internal pressure and external pressure, and thus guaranteeing the acoustic performance.

In addition, an air guiding groove 142 that is connected to one leaking hole 141 and a connecting groove 143 that communicates with any two leaking holes 141 are further provided on the side of the base 14 facing away from the inner surface 111. In one embodiment, the speaker module 1 has two leaking holes 141 in total, and the two leaking holes 141 have the same shape and the same size. It is to be understood that the number of the leaking holes may be more than two, and their structures are not limited herein. The air guiding groove 142 and the leaking hole 141 are in one-to-one correspondence, and each air guiding groove 142 extends from one leaking hole 141 to the periphery of the base 14 to achieve leakage. The connecting groove 143 is provided between two adjacent leaking holes 141. In one embodiment, the air guiding groove 142 and the connecting groove 143 have the same depth and the same structure. A thickness between a bottom surface of either the air guiding groove 142 or the connecting groove 143 and the surface of the base 14 is smaller than a thickness of the housing. Either the air guiding groove 142 or the connecting groove 143 is formed by the bottom surface thereof and a circumferential surface surrounding the bottom surface. A thickness between the bottom surface of the groove and the outer surface 112 of the housing is smaller than a thickness between any other portion of the base 14 to the outer surface 112. Thanks to the air guiding groove 142 and the connecting groove 143, blocking of the leaking hole can be avoided to guarantee reliability of the product.

Furthermore, a damping sheet 4 for dust-proof is further provided and covers the side of the base 14 facing away from the inner surface 111. The damping sheet 4 covers the leaking hole 141, the air guiding groove 142 and the connecting groove 143, and the damping sheet 4 can be a PET or a mesh Therefore, in the condition that the overall dust-proof and sealing function is guaranteed, multiple leaking holes 141 and air guiding grooves 142 are provided, and the multiple leaking holes 141 are communicated with each other by the connecting grooves 143, the problem of poor leakage caused by blocking of the leaking holes 141 can be avoided, thereby guaranteeing excellent performance of the speaker module in air leakage and pure sounding.

As shown in FIG. 3, in one embodiment, a flow guiding groove 15 is provided at the outer surface 112, the flow guiding groove 14 is recessed from the outer surface 112 towards the inner surface. The flow guiding groove 15 surrounds the leaking hole 141, and the leaking hole 141 penetrates through the housing 1 and the base 14 via the flow guiding groove 15. Therefore, air can be discharged quickly, and the outlet of the leaking hole 141 will not be blocked, meanwhile blocking of the leaking hole 141 when the outer surface 112 is attached to other objects can also be avoided.

In the present disclosure, the housing is provided with at least two leaking holes communicating with the rear chamber, air guiding grooves that connect the leaking holes with the external environment, and connecting grooves that communicates the leaking holes with each other, so that the processing steps for forming the cone-shaped leaking hole and air guiding groove in the prior art are omitted, the processing is significantly simplified compared to the prior art, the processing is much easier and the manufacture efficiency is higher, and an excellent performance in air leakage and pure sounding is guaranteed.

Although the embodiments of the present disclosure are described above, it is to be understood that, the above embodiments are exemplary, which shall not be interpreted as limitations to the present disclosure. Those skilled in the art could still make alternations, modifications, replacements and variations to the above embodiments within the scope of the present disclosure.

What is claimed is:

1. A speaker module, comprising:

a housing having an accommodating space, wherein the housing comprises an inner surface and an outer surface opposite to the inner surface, and the inner surface and the outer surface together encloses the accommodating space;

a base protruding from the inner surface of the housing;

a speaker accommodated in the housing, wherein the speaker comprises a diaphragm configured to vibrate and sound, and the accommodating space is partitioned into a front chamber and a rear chamber by the speaker;

at least two leaking holes that penetrate inward from the outer surface through the housing and the base and communicate with the rear chamber; and a connecting groove that is recessed from a side of the base facing away from the inner surface and communicates any two of the at least two leaking holes with each other.

2. The speaker module as described in claim 1, further comprising an air guiding groove communicating with a respective one of the at least two leaking holes, wherein the air guiding groove is formed on the side of the base facing away from the inner surface and extends to a periphery of the base.

3. The speaker module as described in claim 2, further comprising a damping sheet that is attached on the side of the base facing away from the inner surface and covers the at least two leaking holes and the air guiding groove, wherein an end of the air guiding groove distal to the at least two leaking holes communicates with the rear chamber.

4. The speaker module as described in claim 1, wherein the connecting groove has a depth identical to a depth of the air guiding groove.

5. The speaker module as described in claim 4, further comprising a flow guiding groove that is recessed from the outer surface towards the inner surface of the housing, wherein the at least two leaking holes penetrates through the housing via the flow guiding groove, and the flow guiding groove extends to a periphery of the housing.

6. The speaker module as described in claim 1, wherein the housing comprises a bottom wall and a side wall that is bent with respect to the bottom wall and extends from the bottom wall, and the base is arranged on the bottom wall.

7. The speaker module as described in claim 1, wherein a hole diameter of each of the at least two leaking holes decreases from the side of the base facing away from the inner surface towards the outer surface.

8. The speaker module as described in claim 7, wherein each of the at least two leaking holes has a maximum hole diameter of 0.17 mm-0.23 mm.

* * * * *